US006068166A

United States Patent [19]

Kilian et al.

[11] Patent Number: 6,068,166

[45] Date of Patent: May 30, 2000

[54] ADJUSTABLE GARMENT HANGER

[76] Inventors: Jeanne Kilian, 3829 No. 7th St., Tacoma, Wash. 98406; Mary E. Morris, 8813 Butte Terr. SW, Lakewood, Wash. 98498

[21] Appl. No.: 09/109,950

[22] Filed: Jul. 2, 1998

[51] Int. Cl.[7] ..... A47G 25/44

[52] U.S. Cl. ..... 223/94; 223/89

[58] Field of Search ..... 223/85, 92, DIG. 1, 223/DIG. 4, 94, 89

[56] References Cited

U.S. PATENT DOCUMENTS

| | | | |
|---|---|---|---|
| 2,678,148 | 5/1954 | Walther | 223/85 |
| 3,451,601 | 6/1969 | Pelavin et al. | 223/85 |
| 3,516,126 | 6/1970 | Berkovits | 223/88 |
| 3,602,408 | 8/1971 | Gaydos | 223/98 |
| 5,052,599 | 10/1991 | Platti | 223/DIG. 4 |
| 5,082,152 | 1/1992 | Chen | 223/89 |
| 5,085,358 | 2/1992 | Lam | 223/94 |
| 5,680,972 | 10/1997 | Clarke | 223/88 |

*Primary Examiner*—Bibhu Mohanty
*Attorney, Agent, or Firm*—Robert B. Hughes; Hughes & Schacht, P.S.

[57] ABSTRACT

An adjustable garment hanger having two sliding bars(12) and a hanger body(10) with stationary strap hooks and support gussets. The sliding bars(12) fit the top bar of the hanger body(10) by way of grooves and use only contact friction to remain in selected positions once they are adjusted.

2 Claims, 2 Drawing Sheets

ADJUSTABLE GARMENT HANGER

BACKGROUND

1. Field of Invention

This invention relates to adjustable garment hangers, specifically to those that will expand to support garments of all sizes.

2. Description of Prior Art

Everyone uses and has used some device to hang clothing while not being worn. Hangers traditionally have been one size for all clothing or have been made of many adjustable parts that made the adjustments complex or inconvenient. Standard hanger manufacturing has been of wire, wood, plastic, and combinations of one or more of them.

Inventors have proposed various methods to adapt existing hangers to attachments or have proposed adjustable hanger bodies that require tension devices to hold the adjustment in place.

None of these previous attempts have adequately solved the problem of adapting to varying sizes of garments. U.S. Pat. No. 2,884,171 to E. W. Knuth(1959) disclosed an attachment for a standard wire hanger that addressed the adjustability but does not solve the inherent weakness of the wire hanger, specifically the inability of it to retain its shape through use. U.S. Pat. No. 5,344,054 to Dale E. Nutter (1994) addressed the adjustability and the rigidity inherently lacking in traditional wire hangers but is composed of several parts that make adjustments inconvenient and lends to lost parts that are required for the adjustments. All prior hanger proposals have been either too complex or have not adequately addressed the varied sizes and materials of which modern clothing are being manufactured.

All garment hangers previously developed do not adequately address the disadvantages:

(a) Hangers that are not the proper size will cause deformation in the shoulder area,especially knit sweaters. Wire hangers have traditionally caused this type of damage to delicate garments.

(b) As children grow and the traditional small hanger remains the same size, it is discarded with the garments. This is an unnecessary waste of resources.

(c) Complicated adjustable hangers are discarded because of lost parts that are required to retain the adjustment or become inconvenient in their methods of adjustment.

OBJECTS AND ADVANTAGES

My invention is meant to resolve the problems described above.

Several objectives and advantages of the present invention are:

(a) to provide a garment hanger to adjust to fit the shoulder seams of shirts,blouses,sweaters, etc. This eliminates the bulges or puckers that normally occur with regular hangers.

(b) to provide an adjustable hanger so simple that it will be retained for the life of the garment and continue to be used after the garment is outgrown.

(c) to provide a foam filled polypropolene hanger that will retain its shape and adjustability for use on any garment regardless of its' weight.

(d) to provide an adjustable garment hanger for childrens' clothing that will continue to adjust and be usable through their growing years.

(e) to provide a garment hanger with adjustable arms and a lower clothing hanger rod with hooks for lower body garments,i.e. pants, slacks,or skirts and slender strap upper garments th at will not b e affected by the adjustments.

(f) to provide an adjustable garment hanger which can be used by commercial institutions that will readily adapt to their clientele's clothing shapes and sizes.

Further objectives and advantages are to provide an adjustable garment hanger that can be massed produced and readily meets the demanding changing needs of consumers. Still further objects and advantages will become evident from the following description and drawings.

DRAWING FIGURES

REFERENCE NUMERALS IN DRAWINGS

1 Hanger body
2 Slide bar
3 Strap hooks
4 Gussets

Description-FIGS. 1 to 5

Figure 1:
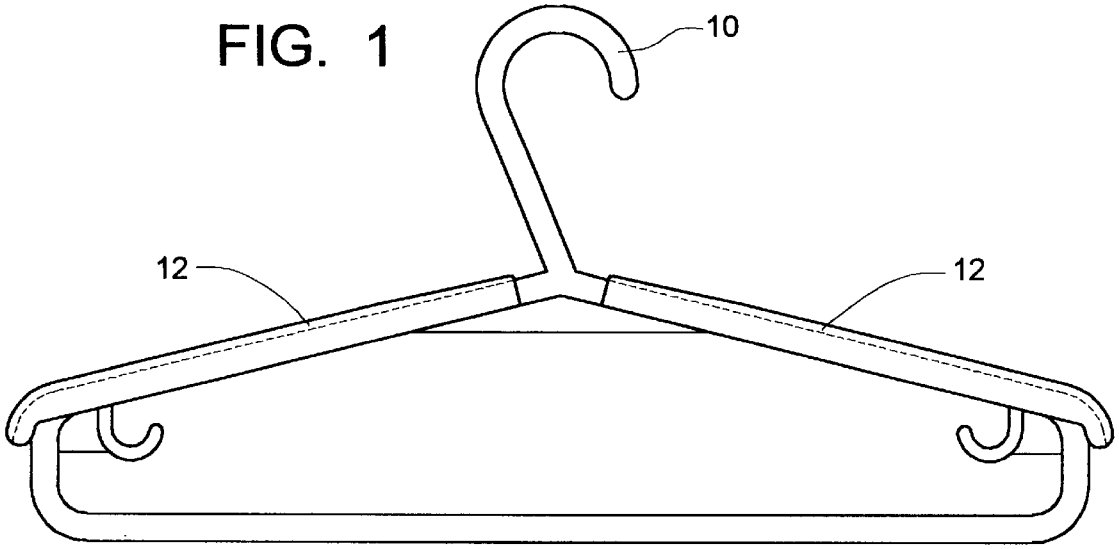
FIG. 1 shows the complete hanger with all parts labeled.

A typical embodiment of the adjustable garment hanger is shown in FIG. 1. The body 10 is formed from foam filled polypropolene. The two identical slide bars 12 are form fit to the body 10 and are held in place through friction and garment weight. Each of the upper angles are supported by gussets 14 that provide structural support for the body 10 and provide attachment support for the strap hooks 13 on the under side of the top body bar.

Figure 2:
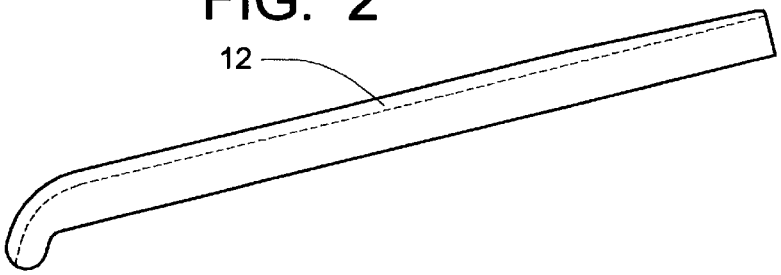
FIG. 2 shows the cross section of the slide bar and the body of the hanger.
Figure 3:
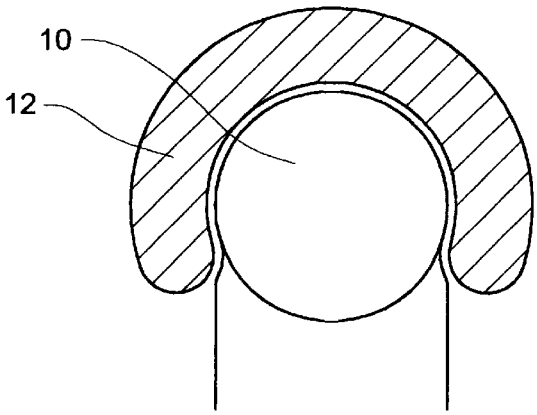
FIG. 3 shows the tapered slide bar that is attached to each side of the hanger body.

The slide bars 12 are formed such that they will slide onto the body with bar to body friction which will retain them in their selected position. FIG. 2 shows the compatible fit of the slide bars around the hanger body. The slide bars fit into grooves on each side of the hanger body to keep it in place during and following adjustment of the slide bars. The bars will provide approximately 6" of extended hanger width when fully extended. FIG. 3 illustrates the slide bar(s) which are also rounded on the ends to support the garment shoulder seams.

Figure 4:
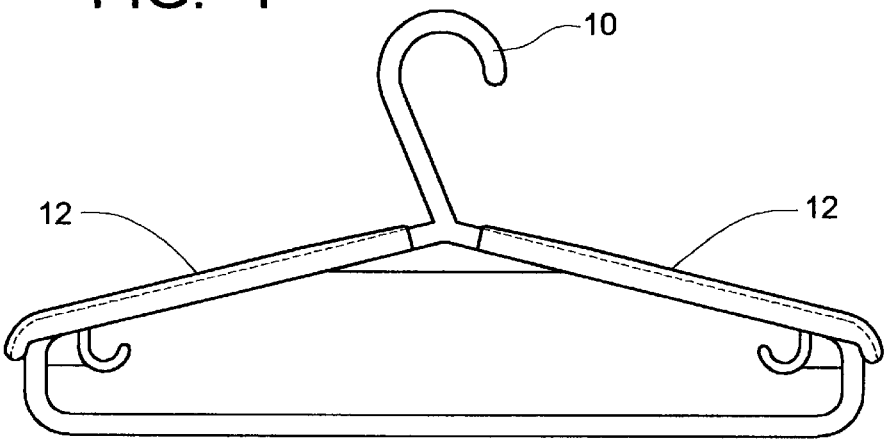
FIG. 4 shows the hanger in its smallest size with slide bars fully retracted onto the upper body arms.
Figure 5:
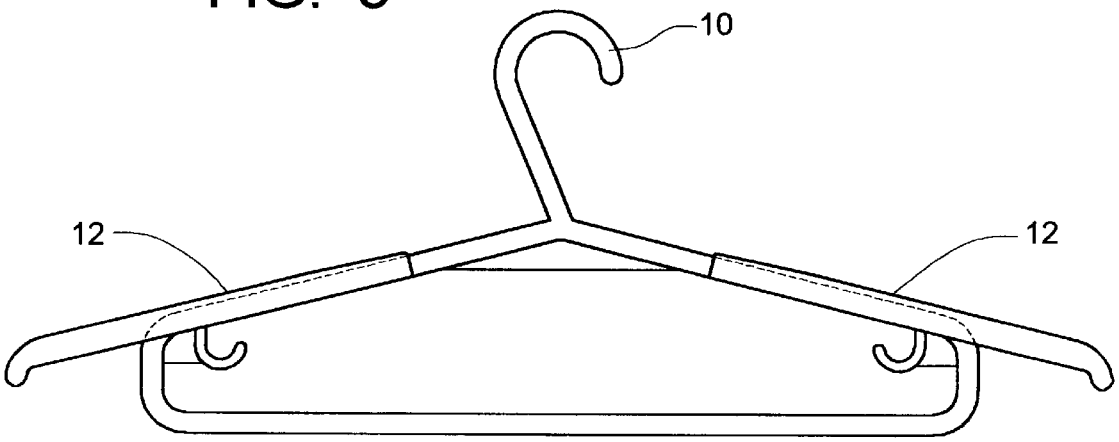
FIG. 5 shows the hanger with slide bars extended to accommodate larger garments.

FIG. 4 shows the hanger in its fully retracted shape. FIG. 5 illustrates the adjustable slide bars 12 in an extended position on each side of the hanger.

operation

The use and operation of the adjustable garment hanger is exceptionally simple. In typical usage the adjustable garment hanger the slide bars are positioned from their completely closed position to any extended position depending on the size of the garment. The slide bars simply slide along the hanger bar and is held in place by friction between the bars and the hanger. The bars may be extended prior to placing the garment on the hanger or they may be extended after the garment is on the hanger. Lower body garments may be draped over the lower hanger rod or from the garment hooks. There are no requirements for mechanical securing devices or any other means to secure the slide bars in their selected position.

SUMMARY RAMIFICATIONS, AND SCOPE

Accordingly the reader will see that through the simplicity of the sliding bar extensions of this adjustable garment hanger, it will accommodate a wide range of upper body clothing. In addition the strength and adaptability will provide a long life of useful service which negates the continual need for replacing garment hangers as they lose their shape or garment size changes. Furthermore the adjustable garment hanger has the additional advantages in that:

- it provides a solution to the problem of damage to sweaters, oversized shirts and delicate garments resulting from inadequate support at the shoulder seam;
- it provides an adjustable hanger that changes with the changes sizes of children's clothing;
- it permits immediate and easy adjustment of the hanger size when changing from one garment size to another;
- it provides a hanger that will retain its shape through the life of many garments thus reducing the need to discard, recycle or replace it;
- it provides a simple hanger that can be mass produced;
- it provides a hanger which when used in large institutions such as hotels and hospitals will provide each user with a garment hanger that readily adapts to their specific need.

Although the description above contains many specificities, these should not be construed as limiting the scope of the invention but as merely providing illustrations of some of the presently preferred embodiments of this invention.

Thus the scope of the invention should be determined by the appended claims and their legal equivalents, rather than by the examples given.

We claim:

1. An adjustable garment hanger comprising:

a) a main body comprising:

i) a hook portion;

ii) two oppositely extending support arms each having a substantially uniform rounded cross-sectional configuration, and each of which has an inner end connected to the hook portion and an outer end;

iii) a cross bar having opposite end portions and extending between the outer ends of the two support arms;

iv) two end connecting portions, each of which has an upper end that connects a related end of one of the support arms, and a lower end that connects to an adjacent end of the cross bar;

b) a pair of elongate slide bars, each of which has an inner end, an outer end, an elongate top portion, and two elongate side portions extending from the top portion downwardly and around side surface portions of a related one of the two support arms to define a lengthwise channel which extends substantially the entire length of the slide bar, the two side portions of each slide bar having lower gripping edge portions which extend a substantial length of the slide bar and extend inwardly toward one another around lower side surface portions of the support arm so as to be spaced from each other by a predetermined spacing distance to grip its related support arm and to keep the slide bar in engaged alignment with its related support arm.

c) the upper end of each of the connecting portions having two oppositely positioned lateral recesses spaced from one another by a recess spacing distance no greater than approximately said predetermined spacing distance, and arranged to receive the lower gripping edge portions of its relating slide bar;

d) two garment hooks, each having an upper end portion connected to an outer portion of a related one of the arm portions of the hanger and extending downwardly therefrom;

e) two gussets at opposite ends of the hanger, each gusset extending between, and connecting to, at least an upper end portion of a related one of the end connecting portions also connecting to an outer portion of a related one of the two support arms, and also connecting to a related one of the two garment hooks, so as to resist rotation of the connecting portion relative to the support arm to which it is connected and also to provide reinforcement for the garment hook;

f) the lengthwise channel of each slide bar being downwardly open at the inner end of the slide bar and also along substantially the entire length of the slide bar to the outer end of the slide bar so that each slide bar can be mounted to its related support arm by aligning the inner end of the slide bar with the outer end of its related support arm and moving the slide bar into engagement with the port arm, with the gripping edges of the slide bar engaging the two recesses of its related connecting portion and also engaging its related slide bar in gripping engagement.

2. The hanger as recited in claim 1, wherein each of the slide bars has at its outer end a downturned end portion forming a generally convex curve.

* * * * *